United States Patent [19]

Hoshi

[11] Patent Number: 4,481,878

[45] Date of Patent: Nov. 13, 1984

[54] METHOD OF AND APPARATUS FOR PRINTING SERIAL NUMBERS

[75] Inventor: Toshio Hoshi, Toride, Japan

[73] Assignee: Komori Printing Machinery Co., Ltd., Tokyo, Japan

[21] Appl. No.: 476,223

[22] Filed: Mar. 17, 1983

[30] Foreign Application Priority Data

Mar. 24, 1982 [JP] Japan ..... 57-47691

[51] Int. Cl.[3] ..... B31F 1/07; B44B 5/00

[52] U.S. Cl. ..... 101/23; 101/76; 101/217

[58] Field of Search ..... 101/18, 22, 23, 29, 101/32, 76, 91, 52, 53, 175, 177, 216, 217; 118/44, 46

[56] References Cited

U.S. PATENT DOCUMENTS

| | | | |
|---|---|---|---|
| 1,742,363 | 1/1930 | Martinek | 101/32 X |
| 1,819,793 | 8/1931 | Ross | 118/44 |
| 2,995,081 | 8/1961 | Crissy et al. | 101/91 |
| 3,129,662 | 4/1964 | Pinkerton | 101/91 X |
| 3,247,785 | 4/1966 | Shultz | 101/23 |
| 3,611,921 | 10/1971 | Jahn | 101/77 |
| 4,024,812 | 5/1977 | Jahn | 101/76 |
| 4,262,590 | 4/1981 | Bruckner | 101/76 |

FOREIGN PATENT DOCUMENTS

| | | | |
|---|---|---|---|
| 482797 | 4/1952 | Canada | 118/44 |

*Primary Examiner*—Edgar S. Burr
*Assistant Examiner*—Charles A. Pearson
*Attorney, Agent, or Firm*—Charles E. Pfund

[57] ABSTRACT

A sheet is pressed by type characters on a numbering device to form a raised portion on the sheet in a character pattern indicative of a serial number. Simultaneously with printing of an image pattern on the sheet, ink is applied to the raised portion on the sheet to visualize the serial number. With no inking device required for the numbering device, the apparatus is simple in overall arrangement and can be constructed less costly.

3 Claims, 7 Drawing Figures

METHOD OF AND APPARATUS FOR PRINTING SERIAL NUMBERS

BACKGROUND OF THE INVENTION

The present invention relates to a method of and an apparatus for printing serial numbers on corners of sheets of value tokens such as bank notes, securities and the like while the value tokens are being printed on the sheets.

It is of prime importance in the printing of value tokens such as bank notes, securities, postage stamps and the like that a record be made of how many value tokens have been printed. Printing presses used for printing such value tokens are generally equipped with counters for recording the number of revolutions of the press and the number of printed sheets that have passed through the press. The printing press also has a serial number printing unit for printing a serial number 2 (FIG. 1 of the accompanying drawings) on a corner of a trimming margin of each printed sheet 1. The printed serial number allows an easy and quick determination of how many sheets have been printed during or at the end of the printing process.

FIG. 2 of the accompanying drawings is a schematic side elevational view of a conventional printing press, showing a serial number printing unit and adjacent parts. A sheet 4 fed, one at a time, onto a feedboard 3 from a paper feeder is transported as it is successively gripped by a swing pre-gripper 5 and grippers on transfer cylinders 6, 7 and an impression cylinder 8 which are rotated in the directions of the arrows. A desired pattern or image is printed on the sheet 4 between the impression cylinder 8 and a plate or blanket cylinder (not shown). The serial number printing unit, generally designated by the reference numeral 9, has a numbering device 10 rotatable about its axis in the direction of the arrow for periodical contact with the sheet 4 travelling around the transfer cylinder 7. The numbering device 10 is constructed such that its number, which is to be printed on the sheet 4, will increase in a single increment each time the numbering device 10 makes one revolution. Above the numbering device 10, there is provided an inking device 18 comprising an ink fountain 11 for containing ink for printing serial numbers, an ink fountain roller 12, a ductor roller 13, a vibrator roller 14, a transfer roller 15, a vibrator roller 16, and an ink form roller 17. A film of ink which is supplied from the inking device 18 to the printing surface of the numbering device 10 is transferred onto a corner of the sheet 4 as it is gripped by the grippers on the transfer cylinder 7 and directed toward the impression cylinder 8, whereupon a serial number is printed on the sheet 4.

With the prior serial number printing unit 9, the serial number is printed by the numbering device 10 on the surface of the sheet 4 which will face a blanket 19 on the periphery of the impression cylinder 8 when the sheet 4 is wound on the latter. Therefore, the printed serial number tends to be transferred from the sheet 4 onto the blanket 19 under pressure imposed when a pattern is printed on the sheet 4. The transferred serial number is then transferred from the blanket 19 back onto a next sheet 4 where it bears a newly printed serial number. This difficulty has been eliminated by cutting off the blanket 19 at a position aligned with printed serial numbers to avoid the transfer of the latter from the sheets 4 onto the blanket 19. Such a recessed blanket, however, is disadvantageous in that it tends to be placed in a distorted disposition with respect to the impression and to be broken from the recess, resulting in a shorter service life of the blanket 19, and a sharp pattern or image cannot be printed on the sheets 4.

SUMMARY OF THE INVENTION

It is an object of the present invention to provide an apparatus for printing serial numbers on sheets of value tokens, which invludes no inking device for the serial number printing and hence is simple in structure and inexpensive to construct.

Another object of the present invention is to provide a method of and an apparatus for printing serial numbers on sheets of value tokens with a reduced amount of labor required for such serial number printing.

Still another object of the present invention is to provide a method of and an apparatus for printing serial numbers on sheets of value tokens with a high degree of efficiency and a reduced amount of wasted paper.

According to the present invention, an ink-free raised portion is formed on a sheet in a character pattern indicative of a serial number to be printed by pressing type characters on a numbering device. At the same time that an image pattern is printed on the sheet, ink is applied to the raised portion on the sheet to visualize the serial nubmer. With the arrangement of the invention, no inking device is necessary for the numbering device, and hence the overall apparatus is simple in structure and easy to maintain and service. Since no inking device is provided for the numbering device, there is no need for maintaining ink for the numbering device, for keeping ink roller pressure, and for cleaning the type characters on the numbering device, process which would otherwise be required. Therefore, less frequent shut down of the printing press for the maintenance and servicing of the numbering device is required. A blanket on the impression cylinder has an increased degree of durability as the blanket needs no recess to avoid the transfer of ink from the printed serial number. According to one aspect of the present invention, there is provided a method of printing a serial number on a sheet, comprising the steps of (a) forming an ink-free raised portion on the sheet in a character pattern indicative of the serial number, (b) printing an image pattern on the sheet, and (c) applying ink to said raised portion to visualize said character pattern simultaneously with said printing step (b).

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
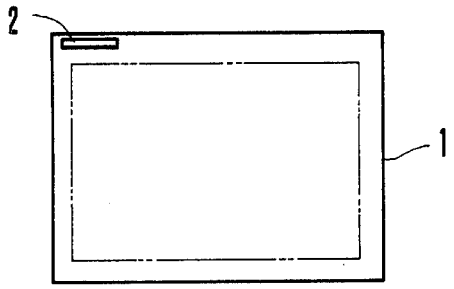
FIG. 1 is a plan view of a sheet on which a serial number is printed.
Figure 2:
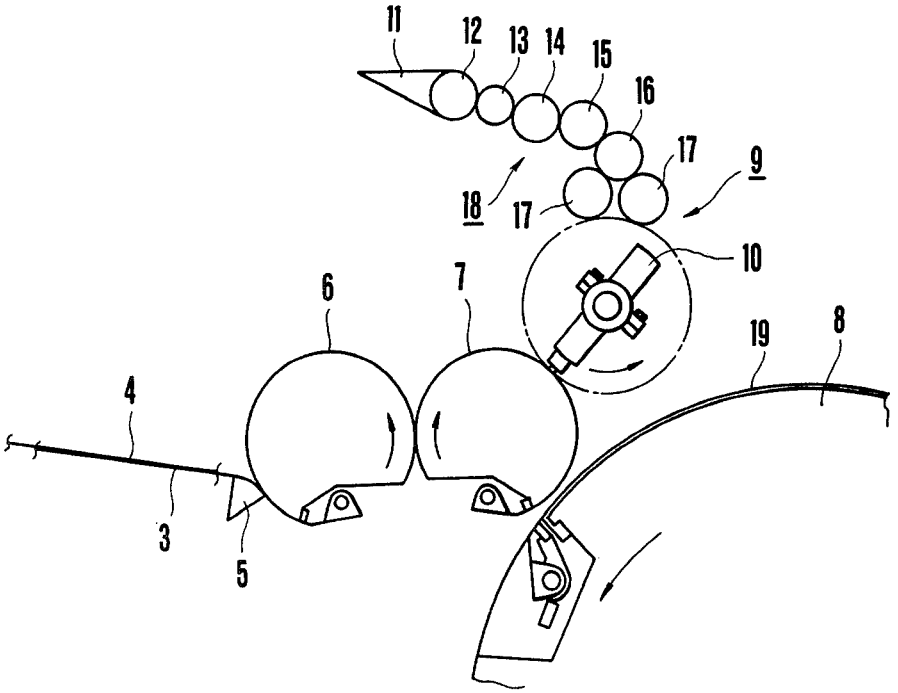
PRIOR ART FIG.2
FIG. 2 is a fragmentary side elevational view of a conventional printing press with a serial number printing unit.
Figure 3:
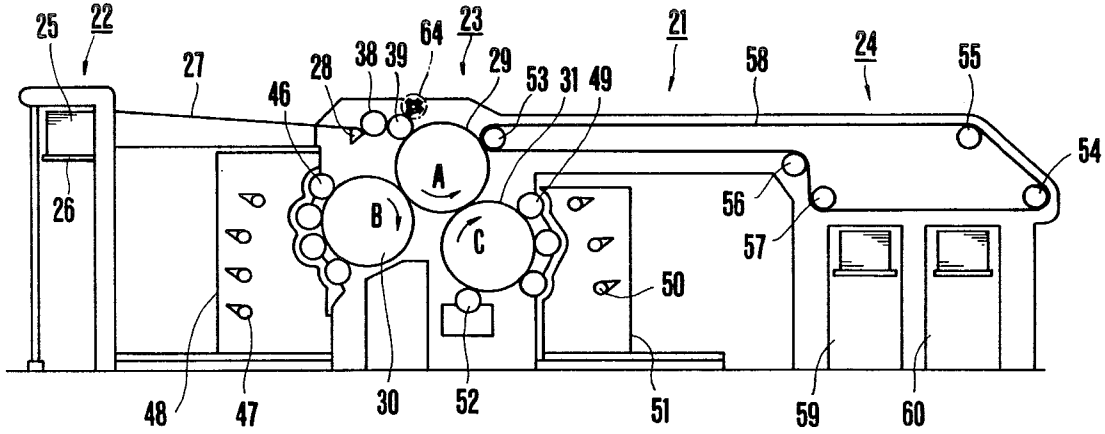
FIG. 3 is a side elevational view of a dry-offset printing press in which a method of and an apparatus for printing serial numbers according to the present invention is incorporated.

A method of and an apparatus for printing serial numbers according to the present invention is particularly useful when embodied in a dry-offset printing press which is generally designated by the reference numeral 21 in FIG. 3. The printing press 21 basically comprises a paper feeder 22, a printing unit 23, and a paper discharger 24. The paper feeder 22 includes a paper pile board 26 for supporting a pile of paper sheets 25 thereon, the paper pile board 26 being automatically elevatable as paper sheets are fed into the printing unit 23. A feedboard 27 extends between the paper feeder 22 and the printing unit 23 for receiving the sheets 25 delivered one by one from the paper feeder 22 and for determining sheet registry. A swing pre-gripper 28 is positioned at a distal end of the feedboard 27 for gripping the sheet 25 on the feedboard 27 and is swingable to supply the gripped sheet 25 to the printing unit 23.

Figure 4:
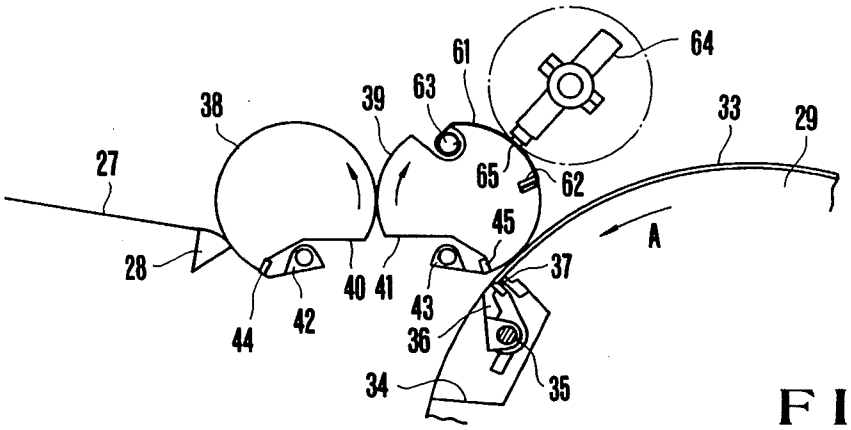
FIG. 4 is an enlarged fragmentary side elevational view of a numbering device and adjacent parts in the printing press shown in FIG. 3.

The printing unit 23 has an impression cylinder 29, a blanket cylinder 30, and an intaglio cylinder 31 rotatable about their own axis in the directions of the arrows A, B, C, respectively, with lines through the cylinder axes extending substantially perpendicularly to each other. The impression and blanket cylinders 29, 30 are held in rolling contact with each other at their peripheral surfaces, and likewise the impression and intaglio cylinders 29, 31 are held in rolling contact with each other at their peripheral surfaces. Each of the cylinders has a diameter dimensioned such that four sheets 25 can be printed during one revolution of these cylinders. As shown in FIG. 4, a resilient blanket 33 is wound peripherally around the impression cylinder 29 with an underlay 32 interposed therebetween. The impression cylinder 29 has in its outer periphery an axial recess or gap 34 with a plurality of grippers 36 and a plurality of gripper pads 37 disposed therein for gripping an edge of the sheet 25. The grippers 36 and the associated gripper pads 37 are supported on a gripper shaft 35 in the recess 34 and a recess wall, respectively, at spaced intervals along the gripper shaft 35. The blanket cylinder 30 also has a rubber blanket (not shown) on its outer periphery. Although not shown, an intaglio printing plate is mounted on the outer periphery of the intaglio cylinger 31.

A pair of transfer cylinders 38, 39 held in mutual rolling contact is disposed between the swing pre-gripper 28 and the impression cylinder 29. The transfer cylinders 38, 39 have peripheral recess or gaps 40, 41, respectively, with a plurality of grippers 42, 43 and a plurality of gripper pads 44, 45 disposed therein at axial intervals for grippingly transferring the sheet 25 fed by the swing pre-gripper 28 to the grippers 36 on the impression cylinder 29. As illustrated in FIG. 3, four plate cylinders 46 for printing four differently colored inks are disposed in rolling contact with the outer periphery of the blanket cylinder 30. A movable inker 48 has four ink fountains 47 with four differently colored inks contained therein, groups of rollers (not shown) associated respectively with the ink fountains 47, and four ink form rollers (not shown) associated with the roller groups and held in rolling contact with the plate cylinders 46, respectively. Three ink form rollers 49 for applying three differently colored inks are disposed in rolling contact with the outer periphery of the intaglio cylinder 31. A movable inker 51 is located behind the ink form rollers 49 and has three ink fountains 50 for supplying three differently colored inks to the ink form rollers 49 through groups of rollers (not illustrated) interposed between the ink form rollers 49 and the ink fountains 50. Obliquely beneath the intaglio cylinder 31, there is positioned by wiping roller 52 in rolling contact with the outer periphery of the intaglio cylinder 31 for wiping off excess ink from the printing plate on the intaglio cylinder 31.

A delivery chain 58 is trained around a sprocket 53 located obliquely upwardly of the impression cylinder 29 and a plurality of sprockets 54, 55, 56, 57 in the paper discharger 24 for trnsporting the sheet 25 released from the grippers 36 on the impression cylinder 29. A pair of paper pile boards 59, 60 is located below an end portion of the delivery chain 58 for receiving alternate stacks of printed sheets 25 that are released downwardly from the delivery chain 58.

Figure 7:
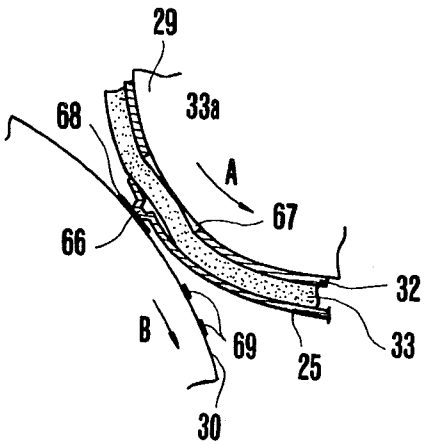
FIG 7 is an enlarged fragmentary cross-sectional view of the impression cylinder and a blanket cylinder in the printing press illustrated in FIG. 3.
Figure 6:
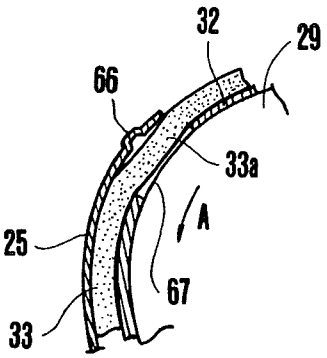
FIG. 6 is an enlarged fragmentary cross-sectional view of an impression cylinder and parts on its peripheral surface in the printing press of FIG. 3.
Figure 5:
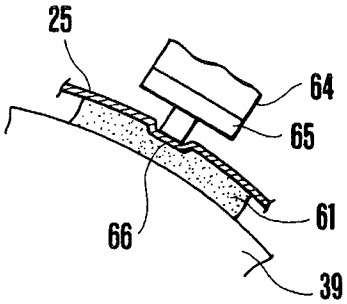
FIG. 5 is an enlarged fragmentary cross-sectional view of a transfer cylinder and associated components in the printing press of FIG. 3.

The printing press 21 additionally includes a serial number printing unit. The transfer cylinder 39 has a resilient blanket 61 with a thickness of about 1.8 mm extending over a portion of the peripheral surface thereof. The blanket 61 has one end held in position by clamping plates 62 with the other end fastened securely to a winding rod 63 so that the blanket 61 is tensioned taut over the peripheral portion of the transfer cylinder 39. Accordingly, any sheet 25 as it is gripped and transported by the grippers 43 is kept against the surface of the blanket 61. The serial number printing unit has a numbering device 64 disposed obliquely upwardly of the transfer cylinder 39 and rotatable therewith. The serial number printing unit includes no inking device for supplying ink to the numbering device 64. The numbering device 64 has on its distal end projecting type characters 65 including a number which increases in an increment each time the numbering device 64 makes one revolution through the aciton of an internal number shifting mechanism therein. The numbering device 64 and the transfer cylinder 39 are in such a relative phase relationship that the type characters 65 will face the blanket 61 on the transfer cylinder 39 after they have rotated through one complete revolution. When brought into confronting relation to the sheet 25 on the blanket 61, the type characters 65 are pressed into the sheet 25 to depress the blanket 61 until the sheet 25 is deformed into a raised portion 66 idential in profile to the type characters 65. The underlay 32 on the impression cylinder 29 has a hole 67 (FIGS. 6 and 7) positioned in alignment with the raised portion 66 of the sheet 25 as it is placed on the impression cylinder 29. The hole 67 in the underlay 32 serves, as best shown in FIG. 7, to relieve a depressed portion **33*a* of the blanket 33 which is resiliently pushed in when the raised portion 66 of the sheet 25 is displaced radially inwardly under pressure imposed between the impression and blanket cylinders 29, 30. Either one of the four plate cylinders 46 includes, in addition to its own pattern plate, a plate surface positioned for transferring a film of ink 68 onto the blanket cylinder 30, from which the ink film 68 is applied to the raised poriton 66 of the sheet 25**.

Printing operation of the printing press 21, and a simultaneous serial number printing process will now be described. A sheet 25 fed by the paper feeder 22 onto the feedboard 27 is gripped by the swing pre-gripper 28, which is angularly moved to transport the sheet 25. The sheet 25 is gripped successively by the grippers 42, 43 on the transfer cylinders 38, 39, and then by the grippers 36 on the impression cylinder 29. The sheet 25 is now wound around and transported by the impression cylinder 29. At this time, four images or patterns of different colors have already been transferred to the blanket cylinder 30 from the four plate cylinders 46 supplied with inks from the inker 48. The four patterns are then printed in the dry-offset printing process on the sheet 25 under pressure between the impression cylinder 29 and the blanket cylinder 30. Three-colored images or patterns have already been formed on the intaglio plate on the intaglio cylinder 31 by being supplied with inks from the inker 51 and wiping off excess ink with the wiping roller 52. These patterns are also printed in the intaglio printing process on the same surface of the sheet 25 when the latter is transported between the intaglio cylinder 31 and the impression cylinder 29. The printed sheet 25 is thereafter transported by the delivery chain 58, and stacked onto either one of the paper pile boards 59, 60.

A serial number is printed on the sheet 25 at the same time that the patterns are printed thereon. More specifically, the type characters 65 of the numbering device 64 as it rotates are pressed into the sheet 25 fed along against the blanket 61 on the transfer cylinder 39. When the type characters 65 are pushed into the sheet 25, the blanket 61 therebelow is depressed to allow the raised portion 66 to be formed in the sheet 25 in the same profile as that of the type characters 65. When the sheet 25 is transported further until the raised portion 66 is held against the blanket cylinder 30 as shown in FIG. 7, the raised portion 66 is pushed down by the blanket cylinder 30 to cause the blanket 33 to be elastically deformed therebelow into the depressed portion 33*a*. The depressed portion 33*a* enters the hole 67 in the underlay 32, preventing the raised portion 66 from being pressed flatwise. Simultaneously with the formation of patterns 69 on the blanket of the blanket cylinder 30, the ink film 68 has already been supplied from the inker 47 via one of the plate cylinders 46 to the blanket on the blanket cylinder 30 at a position aligned with the raised portion 66 of the sheet 25. As a consequence, the ink film 68 is then transferred from the blanket cylinder 30 onto the raised portion 66. By forming the raised portion 66 at a prescribed position such as a corner on the sheet 25, a serial number represented by the type characters 65 can be embossed on the corner of the sheet 25. Although the embossed serial number does not look so sharp as the printed patterns, it is clear enough to allow a sufficient judgement of how many sheets have been printed in the printing process.

The numbering device 64 has a known mechanism (not shown) for automatically stopping its counting-up when no printing is effected due to impression throw-off caused by an improperly fed sheet or the like. Therefore, there is no danger for the current serial number to disagree with the number of sheets which have been printed.

While in the illustrated embodiment the blanket 61 on the transfer cylinder 39 is kept taut by the clamping plates 62 and the winding rod 63, the blanket 61 may be fastened in position by screws or may be replaced with a narrower strip of blanket attached by a double-sided adhesive tape to the periphery of the transfer cylinder 39 and having a width large enough to cover only any serial numbers to be printed.

Although a certain preferred embodiment has been shown and described, it should be understood that many changes and modifications may be made therein without departing from the scope of the appended claims.

What is claimed is:

1. An apparatus for printing an image pattern and a serial number on a sheet, comprising:

(a) a transfer cylinder for transferring the sheet in a running direction, said transfer cylinder having a first resilient member covering at least a portion of a peripheral surface thereof;

(b) an impression cylinder disposed in rolling contact with said transfer cylinder downstream of said transfer cylinder with respect to said running direction and having a second resilient member covering a peripheral surface thereof;

(c) a printing cylinder disposed in rolling contact with said impression cylinder for printing an image pattern on the sheet which is transferred from said transfer cylinder to said impression cylinder and held against the latter;

(d) a numbering device for pressing the sheet against said first resilient member to form an ink-free raised portion on the sheet in a character pattern indicative of the serial number; and (e) an ink applying device for applying an ink image pattern to said printing cylinder and a film of ink at a position thereon aligned with said raised portion on the sheet as it is placed on said impression cylinder, said film of ink being transferred to said raised portion and a plane image pattern printed on the sheet by said printing cylinder in a single pass of said sheet through the nip of said printing cylinder and said impression cylinder to produce both an ink pattern and an inked raised serial number on said sheet.

2. An apparatus according to claim 1, wherein said first resilient member comprises a blanket kept taut on said portion of the peripheral surface of said transfer cylinder.

3. An apparatus according to claim 1, wherein said second resilient member comprises a blanket disposed peripherally around said impression cylinder, including an underlay interposed between said blanket and said peripheral surface of said impression cylinder, said underlay having a hole at a position thereon aligned with the raised portion on the sheet as it is placed on said impression cylinder, whereby said blanket can be depressed into said hole when said printing cylinder is held against said raised portion to transfer said film of ink to the latter.

* * * * *